US006955242B2

(12) United States Patent
Markovich

(10) Patent No.: US 6,955,242 B2
(45) Date of Patent: Oct. 18, 2005

(54) RETRACTABLE SCAFFOLD SUPPORT

(76) Inventor: Mark E. Markovich, 7047 Whitney Woods, Fenton, MI (US) 48430

( * ) Notice: Subject to any disclaimer, the term of this patent is extended or adjusted under 35 U.S.C. 154(b) by 0 days.

(21) Appl. No.: 10/321,990

(22) Filed: Dec. 17, 2002

(65) Prior Publication Data

US 2004/0112675 A1 Jun. 17, 2004

(51) Int. Cl.[7] ..... E04G 3/00
(52) U.S. Cl. ..... 182/82
(58) Field of Search ..... 182/82, 150; 248/240, 248/239; 52/127.7

(56) References Cited

U.S. PATENT DOCUMENTS

| | | | | |
|---|---|---|---|---|
| 201,823 A | * | 3/1878 | oaks | 248/240 |
| 827,540 A | * | 7/1906 | Krahmer | 248/240 |
| 954,857 A | * | 4/1910 | Fawcett | 248/240 |
| 2,988,181 A | * | 6/1961 | Darrey | 52/646 |
| 3,698,680 A | * | 10/1972 | Shoemaker | 249/189 |
| 4,022,293 A | | 5/1977 | Hallagin | |
| 4,153,229 A | | 5/1979 | Bequette | |
| 4,673,060 A | | 6/1987 | Gregory | |
| 5,257,766 A | | 11/1993 | Riblet | |
| 5,259,477 A | | 11/1993 | Fears et al. | |
| 5,316,253 A | | 5/1994 | Flathau et al. | |
| 5,503,358 A | | 4/1996 | Lapp | |
| 5,775,655 A | | 7/1998 | Schmeets | |

FOREIGN PATENT DOCUMENTS

FR 2610348 A1 * 8/1988 ..... E04G 17/00

* cited by examiner

*Primary Examiner*—Alvin Chin-Shue
(74) *Attorney, Agent, or Firm*—Harness, Dickey & Pierce, PLC

(57) ABSTRACT

A retractable scaffold support bracket is provided for mounting on the exterior surface of a concrete wall form. The bracket can be pivoted from an open enabling position to a closed locked position for transport or storage of the form walls. The bracket is of substantially triangular shape comprising a support plate, a vertical rod member, and a reinforcing truss. The vertical rod member is pivotally attached to a mounting base which secures the support bracket to the concrete form wall. The position of the support bracket is maintained in either the open or closed position by a locking element attached to the mounting plate and can be moved switched between the two positions by simply lifting and pivoting the bracket to the desired position.

1 Claim, 5 Drawing Sheets

RETRACTABLE SCAFFOLD SUPPORT

FIELD OF THE INVENTION

The present invention relates to a retractable scaffold support. More particularly, the present invention relates to a retractable scaffold support for use on concrete forms that can be pivoted to lay flat against the side of form for storage and transportation.

BACKGROUND OF THE INVENTION

Scaffolds are widely used on concrete forms to allow a worker to access, adjust or set up the tall forms. Furthermore, with the type of gang forms used to create concrete walls, it is often necessary for the worker to climb up near the top to direct the flow of concrete as it is delivered.

Many of the prior art scaffolds are of the free standing type designed to be erected on the ground adjacent to a concrete form wall. These scaffolds require multiple support frames which are burdensome to transport and store, as well as time consuming to erect and adjust. Other types of prior art scaffolds are affixed to the sides of the forms but are usually permanently positioned once mounted, requiring the entire bracket assembly to be removed prior to transportation or storage of the form walls.

Folding scaffold brackets such as the one disclosed in U.S. Pat. No. 4,673,060 by inventor Gregory have been widely used in substitution of the above types of scaffolds. The advantage of having a foldable bracket is that it does not need to be removed from the form wall prior to the transportation thereof. This design requires the removal of a securing pin from each of the scaffold support brackets used, prior to the bracket and scaffold being folded flat against the form wall. As a result, there is a risk of loosing the pins around a construction site, and furthermore, the folding process may require more than one individual to disengage the brackets simultaneously prior to folding.

As a result of the aforesaid shortcomings of prior art scaffold support designs, the need arose for a scaffold support bracket that can be attached to the side of a concrete form wall and easily folded flat for transportation and storage thereof without the need to remove the bracket beforehand.

SUMMARY OF THE INVENTION

It is therefore an object of the present invention to provide for a foldable scaffold support bracket that is simple and economic to manufacture and can be permanently attached to a concrete form wall.

Also, it is a further object of the present invention to provide for a foldable scaffold support bracket that can be easily folded flat against the form wall it is mounted on for transportation and storage thereof.

It is another object of the present invention to provide for a foldable scaffold support bracket that can be folded flat against the form wall it is mounted to without the need to remove any parts prior to.

Finally, it is an object of the present invention to provide for a foldable scaffold support bracket that, once folded by the user to a closed flat position, will maintain that position against the form wall it is mounted to until such time it is desired to be re positioned for use at a later time.

The foregoing objects are accomplished in the preferred embodiment of the present invention by a foldable scaffold support to be used in series with concrete forms comprising a generally triangular support pivotally mounted to a base comprised of two rectangular plates, a tubular hinge portion attached to the plates, and a means of locking the brace in either the open or closed position.

When the support is mounted vertically to a concrete form support beam it can be adjustably oriented in either a closed position wherein the support is flat against the form wall; or an open position where the support is perpendicular to the form wall for supporting a scaffold walkway such as a plank. Adjustment between the two positions is achieved by simply lifting up on the support and pivoting it horizontally on its base to either desired position. Upon release, the support will lock in position until it is desired to be moved again at a later time.

The triangular support bracket is comprised of a horizontal plate mounted to a perpendicular shaft at one end. A second metal plate connects the free end of the horizontal plate with the free end of the perpendicular shaft forming the hypotenuse of the triangular bracket. A short vertical plate is mounted to the end where the horizontal plate is attached to the hypotenuse for preventing the floor board from sliding off the support bracket.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The foldable scaffold support bracket of the present invention, labeled generally as 10 as shown in FIGS. 1–6, is designed to be mounted in series to the vertical supports on the exterior wall of a concrete form for supporting one or more horizontal plank walkways there on. The preferred embodiment comprises two independent, but inseparable, complementary elements, the mounting base element 12 and the support bracket 14, and a locking means 21.

Figure 1:
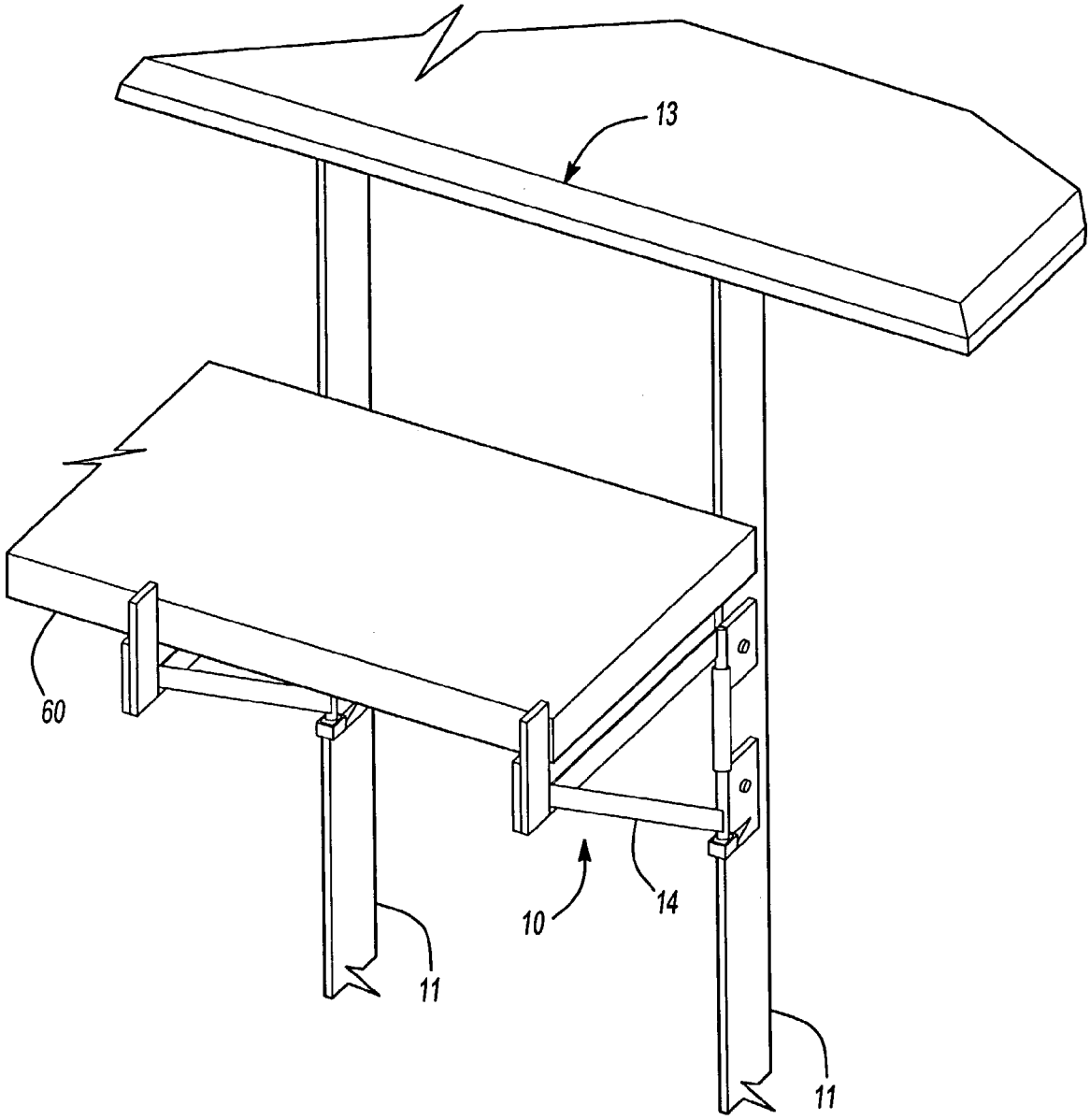
FIG. 1 is a perspective view of the preferred embodiment attached to a concrete form in the open locked position supporting a scaffold plank.

As shown in FIG. 1, the preferred embodiment of the scaffold bracket 10 is to be mounted to a vertical support beam 11 of a concrete wall form 13. Designed to be used in series, once two or more scaffold support brackets 10 are attached to the concrete form 13 on adjacent support beams 11, a scaffold plank 60 is supported on top of the brackets 10, allowing a worker to walk or stand upon the plank to perform their required duties with ease.

Figure 2:
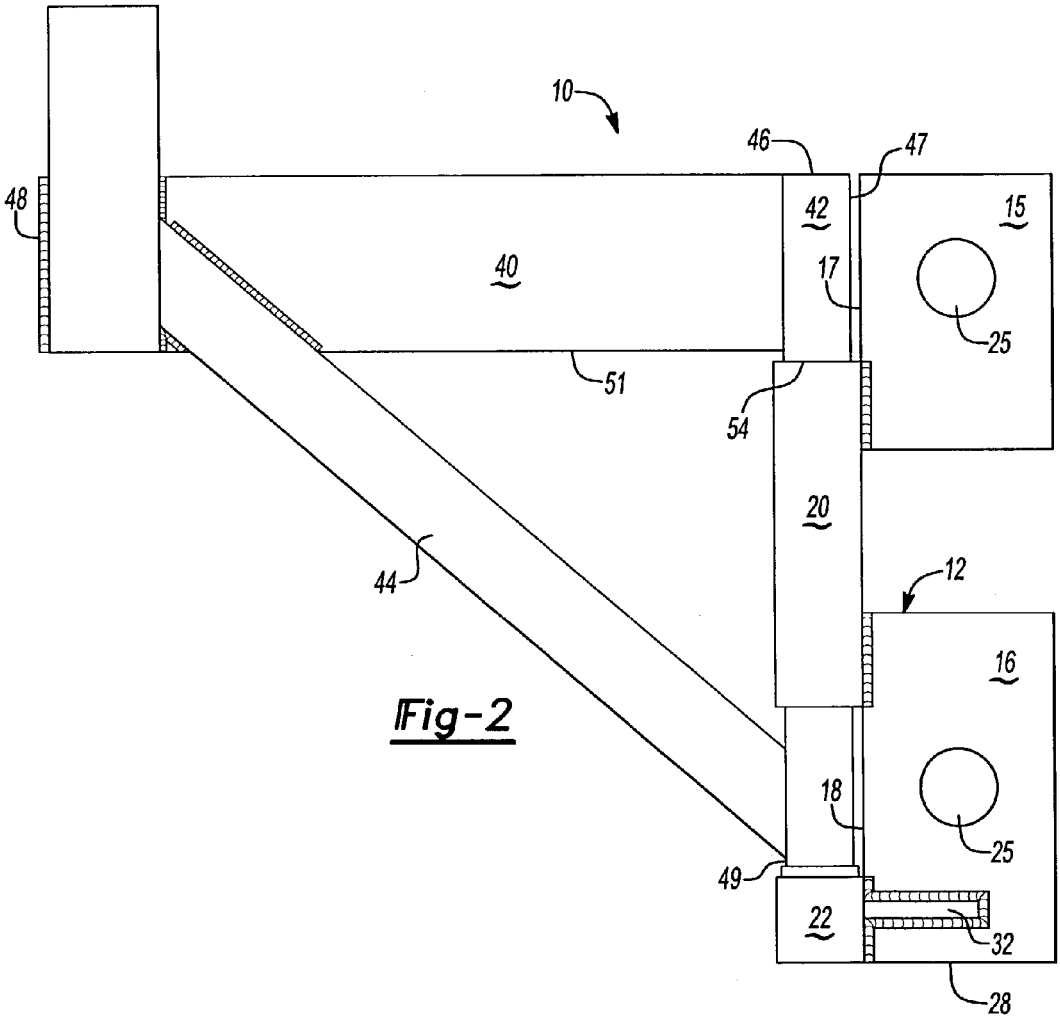
FIG. 2 is a side view of the preferred embodiment in the open locked position.
Figure 3:
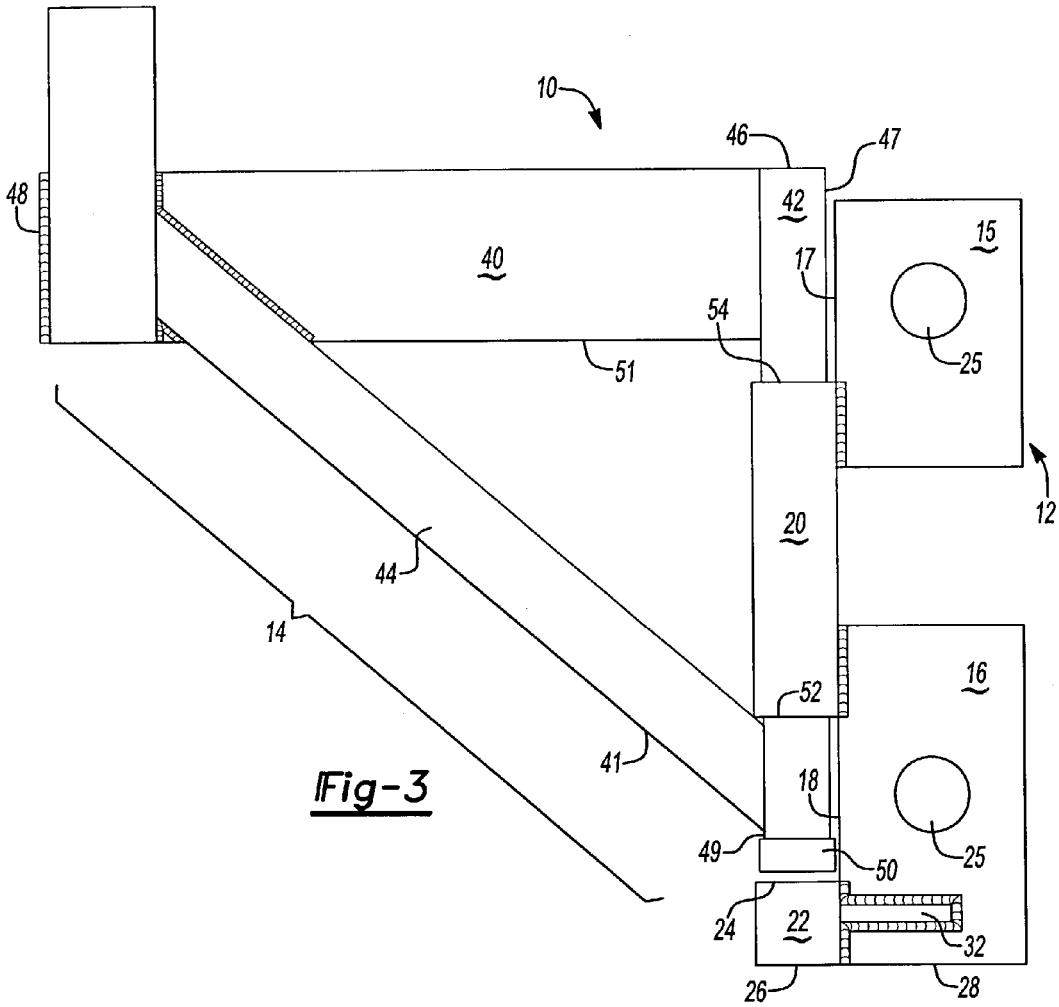
FIG. 3 is a side view of the preferred embodiment in the open unlocked position wherein the bracket may be pivoted freely.

Referring now specifically to FIGS. 2–3, there is shown the preferred embodiment of the foldable scaffold bracket 10 in both the open locked position and the open unlocked position respectively. In the open locked position, a horizontal plank may be placed thereon, providing a convenient walkway for standing or walking upon. In the unlocked position, achieved by lifting up on the support bracket 14, the support bracket 14 may be manually pivoted from the open position shown in FIGS. 2–3 where as a scaffold plank 60 may be placed on the bracket 14 for standing or walking, to the closed position, shown in FIGS. 5–6, for transportation or storage of the concrete forms 13 with the convenience of having the bracket 14 substantially parallel to the wall form 13 to save space during storage.

As shown in FIGS. 2–3, the mounting base 12 is comprised of a first steel plate 15 and a second steel plate 16 both of a general rectangular shape. The first plate 15 and second plate 16 are positioned in-line and planar, a predetermined distance apart, and are connected by way of a central pivot tube 20 welded along one side, adjacent and parallel to both first edge 17 of plate 15 and second edge 18 of plate 16. The tube 20 is attached so as to span the gap between the first plate 15 and second plate 16 and extend a predetermined distance beyond the gap along both edges 17 and 18, so as to provide a secure connection between the three components. Furthermore, plates 15 and 16 have one or more holes (not numbered) for attaching the mounting base 12 to a vertical support frame 11 of a concrete wall-form 13.

Figure 4:
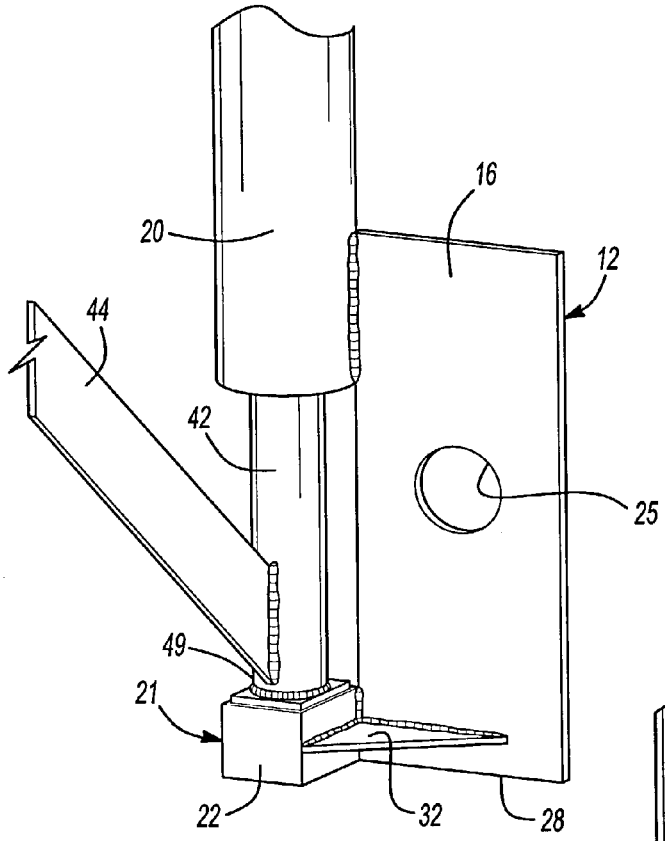
FIG. 4 is a partial perspective view of the locking mechanism of the preferred embodiment wherein the bracket is in the closed locked position.
Figure 5:
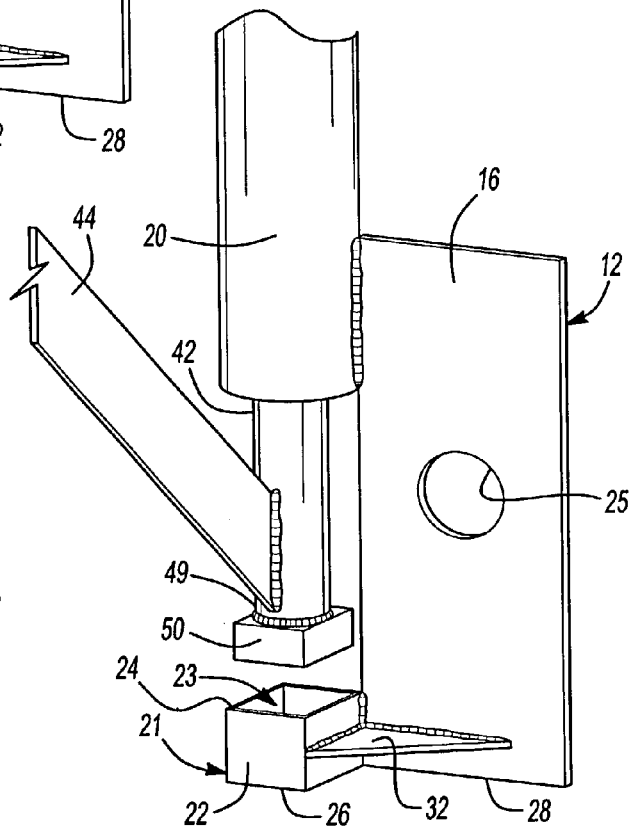
FIG. 5 is a partial perspective view of the locking mechanism of the preferred embodiment showing the bracket in the closed, but unlocked position, wherein the bracket may be pivoted freely.
Figure 6:
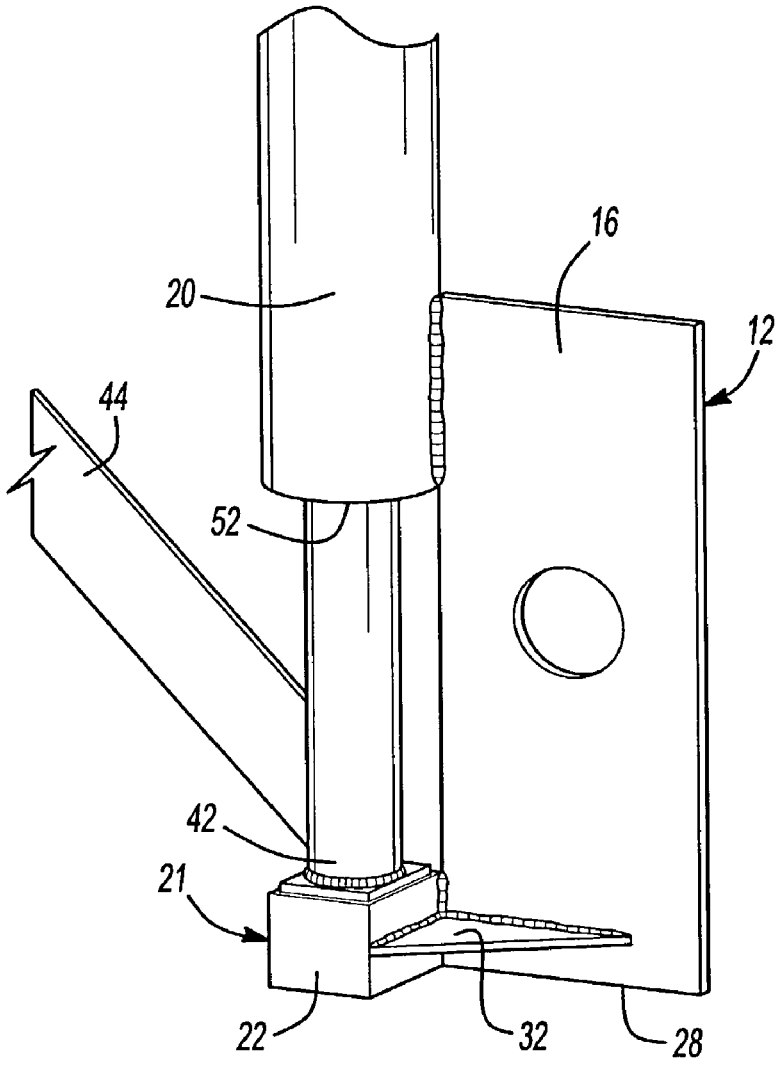
FIG. 6 is a partial perspective view of the locking mechanism of the preferred embodiment wherein the bracket is in the open locked position.

FIGS. 4–6, further show the second plate 16 embodying a square locking tube 22 of a predetermined length with a bore through 23 for receiving a locking end 50 of the support bracket 14. The locking tube 22 is welded to the second plate 16 along second edge 18, in-line with the pivot tube 20 but located distally along edge 17 a predetermined distance from the lower end 52 of pivot tube 20. The locking tube has both a first end 24 proximal to the lower end 52 of pivot tube 20 for receiving the locking end 50 of the support bracket 14, and a second end 26 positioned flush with edge 28 of second plate 16. The locking tube 22 is further reinforced against breakage by a triangular reinforcing plate 32 welded perpendicular to the second plate 16 and locking tube 22 a predetermined distance from edge 28 of second plate 16.

The support bracket 14 comprises three main elements: a horizontal support plate 40 for supporting a horizontal scaffold plank 60 that may be placed thereupon, a vertical shaft 42 for pivotal attachment to the pivot tube 20 of the mounting base 12, and a truss plate 44 for reinforcing support plate 40, all welded together in a generally triangular orientation.

Specifically, support plate 40 is welded at a first end perpendicular to and generally planar with pivotal shaft 42 at a first end thereof, forming a right angle. The terminal end 46 of shaft 42 and terminal end 48 of plate 40 are welded planarly to the truss plate 44, forming the hypotenuse of the triangle.

Referring now to FIGS. 4–6, a detailed drawing of the locking means 18 is shown in both the locked and unlocked positions. Specifically, FIG. 4 shows the locking means 18 whereas the mounting bracket 14 is in the closed locked position and the support bracket 14 is generally perpendicular to the mounting base 12 and generally parallel to the concrete wall form 13.

Once the scaffold bracket 10 is attached to a concrete form 13, the support bracket 14 can be manually pivoted from the closed locked position to the open locked position with ease. To release the locking means and change positions of the support bracket 14, the user simply lifts up on the support bracket 14, causing the pivotal shaft 42 to slide vertically through the tube 20 of the mounting base 12 enough to cause the locking end 50 of the pivotal shaft 42 to slide completely out and free of the locking tube 22. Complete separation of the support bracket 14 from the mounting base 12 is prevented when the top edge of the truss plate 44 comes in contact with the lower end 52 of the pivot tube 20. Once the support bracket 14 is in the raised unlocked position, it can be pivoted to either the open position or the closed position. Once positioned in the desired orientation, the used simply lowers the support bracket 14, causing the pivotal shaft 42 to slide through the pivot tube 20 and further enabling the locking end 50 of the pivotal shaft 42 to be inserted into the locking tube 22 to a predetermined distance. Further lowering of the support bracket 14 is prevented once the lower edge of the support plate 40 contacts the upper end 54 of the pivot tube 20.

The description of the invention is merely exemplary in nature and, thus, variations that do not depart from the gist of the invention are intended to be within the scope of the invention. Such variations are not to be regarded as a departure from the spirit and scope of the invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A retractable scaffold support attached to a vertical member of a cement form wall comprising:

a mounting base, said mounting base comprising an upper and lower steel plate having at least one mounting hole through each of said upper and lower plate, said plates being vertically attached to said vertical member of said cement form, said upper and lower plate planarly connected by a vertical cylindrical tube;

a generally triangular support frame, said support frame comprising a vertical member, a horizontal board supporting member extending transversely from said vertical member of said support frame, and a bracing member extending from said vertical member to said horizontal board supporting member forming a right-triangular support frame, said vertical member of said support frame being cylindrical and rotatably received within said vertical cylindrical tube of said mounting base, pivotally attaching said triangular support frame to said mounting base;

a square locking means attached to said lower plate of said mounting base and receiving a complimentary square element attached to a lower end of said vertical cylindrical vertical member for selectively maintaining said support frame in a first, open position, wherein an orientation of said triangular support frame is planar with said upper and lower steel plates, providing for the release of said support frame from said first position to allow said support frame to pivot to a second, closed position wherein said orientation of said triangular support frame is maintained generally perpendicular to said upper and lower plates.

* * * * *